US010286261B1

(12) United States Patent
Urioste et al.

(10) Patent No.: US 10,286,261 B1
(45) Date of Patent: May 14, 2019

(54) BOCCE BALL RETRIEVER

(71) Applicant: Urioste Sports and Entertainment, LLC, Chandler Heights, AZ (US)

(72) Inventors: Daniel Joseph Urioste, Gilbert, AZ (US); Nathan Jon Urioste, San Jose, CA (US); Martin Miguel Vasquez, Morgan Hill, CA (US)

(73) Assignee: Urioste Sports and Entertainment, LLC, Chandler Heights, AZ (US)

( * ) Notice: Subject to any disclaimer, the term of this patent is extended or adjusted under 35 U.S.C. 154(b) by 0 days.

(21) Appl. No.: 16/016,461

(22) Filed: Jun. 22, 2018

Related U.S. Application Data

(60) Provisional application No. 62/604,136, filed on Jun. 24, 2017.

(51) Int. Cl.
*A63B 47/02* (2006.01)
*A63B 67/06* (2006.01)

(52) U.S. Cl.
CPC ..... *A63B 47/02* (2013.01); *A63B 67/06* (2013.01)

(58) Field of Classification Search
CPC ..... A47F 13/06; A63B 47/02; A63B 53/14; A63B 53/007; A63B 53/0487; A63B 53/065; A63B 67/06
USPC ..... 294/19.2
See application file for complete search history.

(56) References Cited

U.S. PATENT DOCUMENTS

| | | | | |
|---|---|---|---|---|
| 4,580,784 | A * | 4/1986 | Brill | A63B 47/02 473/286 |
| 6,817,955 | B2 * | 11/2004 | O'Donnell | A63B 57/0037 294/19.2 |
| D577,398 | S * | 9/2008 | Hilton | D21/744 |
| D621,458 | S * | 8/2010 | Serrano | D21/736 |
| 8,328,654 | B2 * | 12/2012 | Demkowski | A63B 53/0487 473/248 |
| 2010/0314893 | A1 * | 12/2010 | Pearson | A63B 47/02 294/19.2 |

* cited by examiner

*Primary Examiner* — Stephen A Vu
(74) *Attorney, Agent, or Firm* — Booth Udall Fuller, PLC

(57) ABSTRACT

A ball retriever base includes an upper surface, a lower surface for coupling to a walking stick or pole. The base includes two prongs extending away from the base with each of the two prongs having a contoured upper surface forming first and second seats sized to receive first and second ball sizes. The two prongs may be made of a flexible material so that when a ball having a weight of at least 1 pound falls into place between the two prongs, the base produces an audible "snap" to indicate the ball is properly seated.

20 Claims, 5 Drawing Sheets

BOCCE BALL RETRIEVER

RELATED APPLICATION

This application claims the benefit of U.S. provisional patent application 62/604,136, filed Jun. 24, 2017, titled "Bocce Ball and, Golf Ball Retriever with Golf Tee Insertion Apparatus," the entirety of the disclosure of which is hereby incorporated herein by this reference.

TECHNICAL FIELD

This disclosure relates to a bocce ball retriever.

BACKGROUND

Leisure sports are enjoyed by a wide variety of people. However, such sports often require the players to retrieve a ball repeatedly. For example, in bocce ball, several balls are thrown each round, and must be picked up again to continue with the game. Golf also involves repeatedly retrieving a ball. Bending or crouching to retrieve the ball can be tiresome and difficult, especially for those with physical limitations.

SUMMARY

According to a particular embodiment, a bocce ball retriever may comprise a walking stick or pole, a base comprising an upper surface, a lower surface opposite the upper surface, and a female receiver located in the upper surface and coupled to the walking stick or pole, the base comprising two prongs extending away from the base from a point adjacent to the lower surface, each of the two prongs comprising a contoured upper surface, wherein a first portion of the contoured upper surfaces of each of the two prongs together forming a first seat sized to receive a first ball size, and a second portion of the contoured upper surfaces of the two prongs forming a second seat sized to receive a second ball size larger than the first ball size, wherein the first portions of the contoured upper surfaces are closer to the female receiver than the second portions of the contoured upper surfaces.

Particular embodiments may comprise one or more of the following features. The female receiver may comprise a threaded surface. The base may be formed of an impact resistant plastic material, such as ABS, polycarbonate, or PDCPD plastic. The two prongs may be made of a flexible material, wherein a ball having a weight of at least 1 pound producing an audible "snap" when falling into place between the two prongs. The flexible material may be an impact resistant plastic material, such as ABS, polycarbonate, or PDCPD plastic. The walking stick or pole may be detachable from the base. The base may further comprise an angle between the lower surface of the base and the walking stick or pole, the angle being less than 90°. Each of the two prongs may comprise an uncoupled end.

According to a particular embodiment, a bocce ball retriever may comprise a base with an upper surface and a coupler located on the upper surface, the base comprising two prongs extending away from the base, each of the two prongs comprising a contoured upper surface, wherein a first portion of the contoured upper surfaces of each of the two prongs together forming a first seat sized to receive a first ball size, and a second portion of the contoured upper surfaces of the two prongs forming a second seat sized to receive a second ball size larger than the first ball size, wherein the first portions of the contoured upper surfaces are closer to the coupler than the second portions of the contoured surfaces.

Particular embodiments may comprise one or more of the following features. The coupler may comprise a threaded surface. 11. A walking stick or pole detachably coupled to the coupler of the base. A lower surface, the two prongs extending away from the base from a point adjacent to the lower surface. Each of the two prongs may comprise an uncoupled end. The base may be formed of an impact resistant plastic material, such as ABS, polycarbonate, or PDCPD plastic.

According to a particular embodiment, a ball retriever may comprise a base with an upper surface and a coupler located on the upper surface, the base comprising two prongs extending away from the base, each of the two prongs comprising a contoured upper surface, wherein a portion of the contoured upper surfaces of each of the two prongs together forming a seat sized to receive a first ball size.

Particular embodiments may comprise one or more of the following features. The coupler may comprise a threaded surface. Each of the two prongs may comprise an uncoupled end. A walking stick or pole detachably coupled to the coupler of the base. The two prongs may be made of a flexible material, wherein a ball having a weight of at least 1 pound producing an audible "snap" when falling into place between the two prongs. The base may be formed of an impact resistant plastic, such as ABS, polycarbonate, or PDCPD plastic.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112112(f). Moreover, even if the provisions of 35 U.S.C. § 112(f), are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings (which are not necessarily to scale), where like designations denote like elements, and.

DETAILED DESCRIPTION

Figure 1:
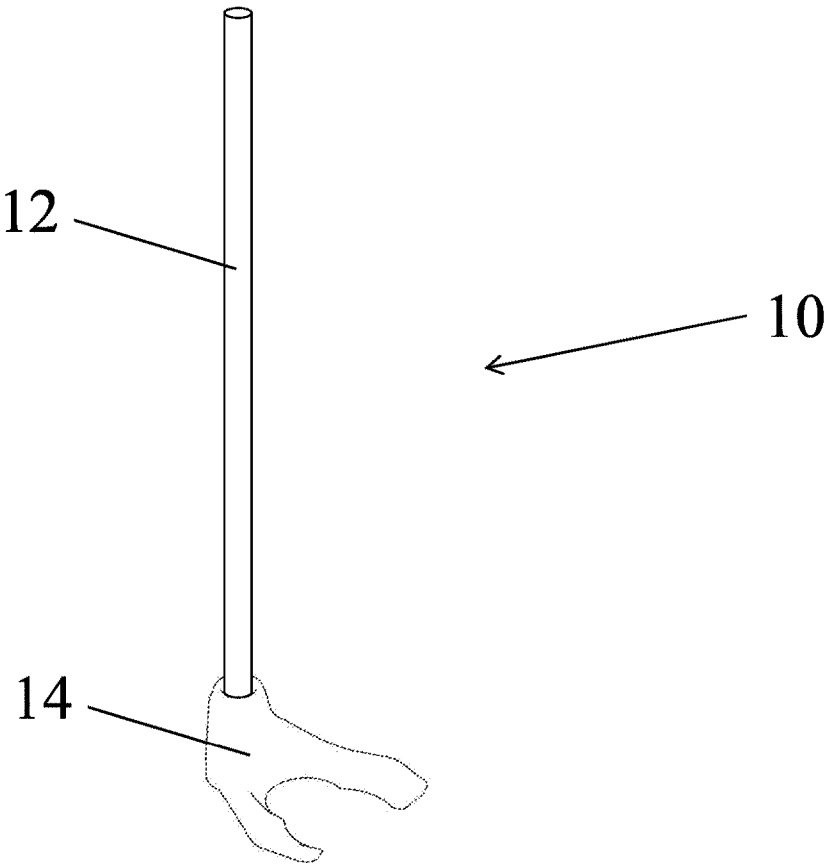
FIG. 1 is a perspective view of a bocce ball retriever.

This disclosure, its aspects and implementations, are not limited to the specific bocce ball retriever or material types, or other system component examples, or methods disclosed herein. Many additional components, manufacturing and assembly procedures known in the art consistent with bocce ball retriever manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Accordingly, this disclosure discloses a ball retriever that can be used to retrieve different sized balls, such as a bocce ball or a golf ball, from a standing, upright position without bending or crouching.

FIG. 1 illustrates a perspective view of a particular embodiment of a ball retriever 10, which may comprise a walking stick or pole 12 and a base 14. The base 14 may be one piece made of any of a variety of types of plastic or composite materials that can be injection molded or 3D printed. In this embodiment, illustrated more closely in FIG. 2, the coupler 20 is a female receiver and the walking stick or pole 12 couples with the base 14 through the insertion of an end of the walking stick or pole into the coupler 20. Alternatively, in other embodiments, the coupler may be a male coupler inserted into a female receiver in the walking stick or pole 12. Other embodiments may utilize a different coupling method. The walking stick or pole 12 may screw, snap, or otherwise attach to the coupler 20, and is configured to be removable in some embodiments.

Figure 2:
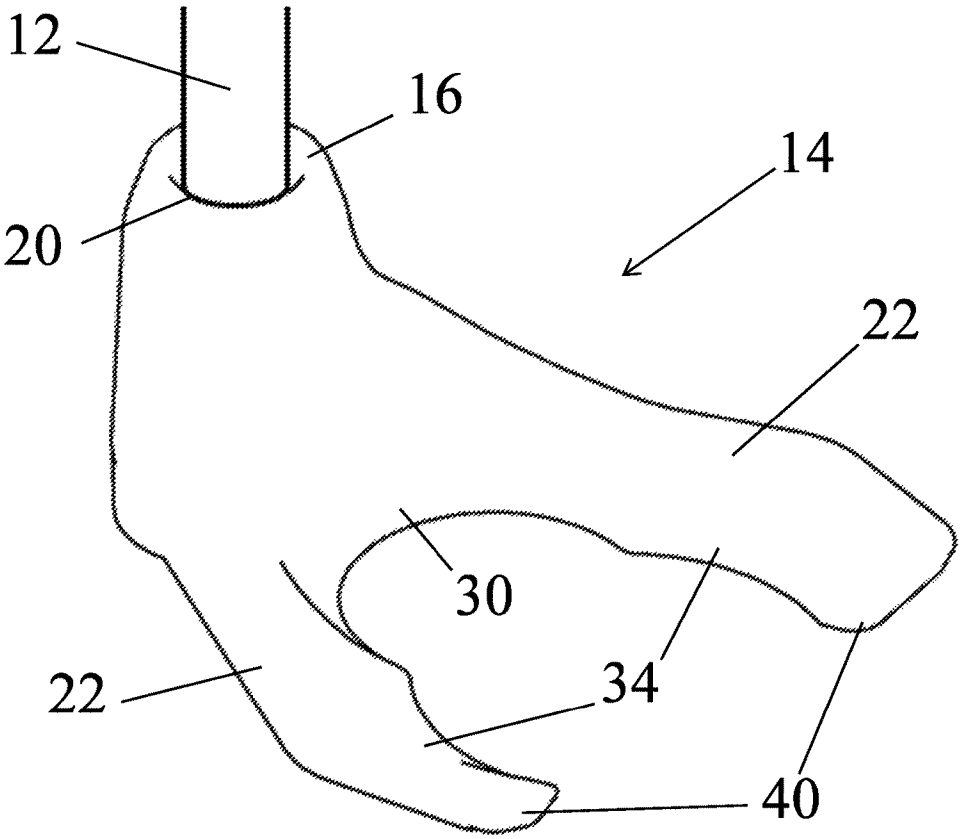
FIG. 2 is a perspective view of the bocce ball retriever base of FIG. 1.

In the embodiment illustrated in FIG. 2, the coupler 20 is located on the upper surface 16 of the base 14. In addition, FIG. 2 shows that the prongs 22 may originate jointly from the base 14 to form the first seat 30 for small balls and extend outwards generally horizontally, in departing angles, to form the second seat 34 for larger balls. In some embodiments, each prong may have an uncoupled end 40. This leaves an opening into the first seat 30 and into the second seat 34. Such embodiments may be easier to use to retrieve a ball because there is no obstacle blocking entrance into either seat.

Figure 3:
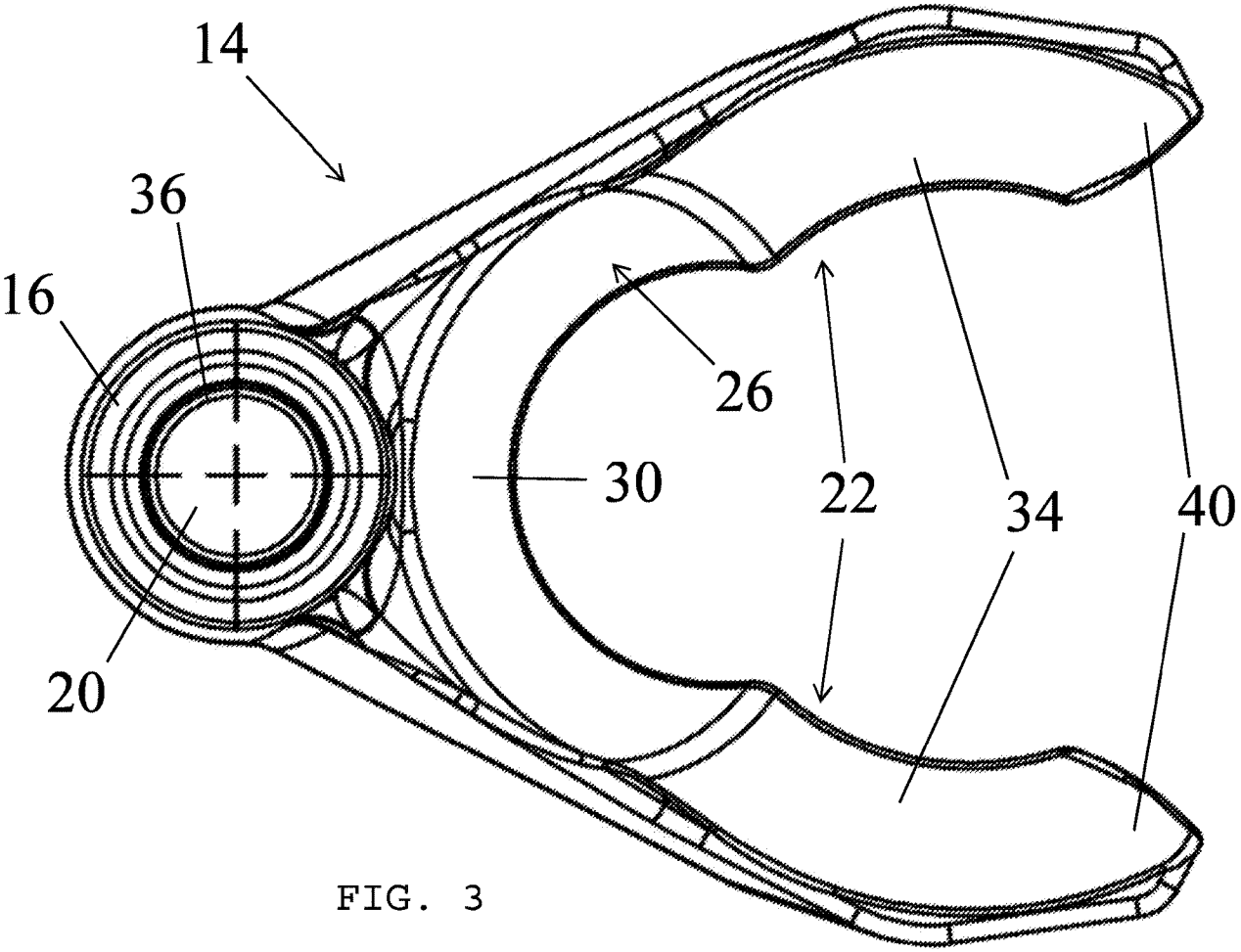
FIG. 3 is a top view of the base of FIG. 1.

FIG. 3 illustrates a top view of the base 14. The coupler 20 in this embodiment has an internally threaded surface 36 that can threadedly couple with the walking stick or pole 12. The upper contoured surface 26 of the prongs 22 may comprise a single or multiple seats for different ball sizes. As seen in FIG. 3, one embodiment comprises two seats, the first seat 30 being closer to the base than the second seat 34. The prongs 22 may be made with a flexible material, such as acrylonitrile butadiene styrene ("ABS") plastic, polycarbonate plastic, or polydicyclopentadiene ("PDCPD") plastic. Materials such as these allow the prongs 22 to grasp, cup, and secure various ball sizes. When a ball is retrieved, the prongs 22 may flex outward to fit the ball better. For certain ball sizes, this produces the audible "snap" because of the fit of the ball inside of the seat and the flex of the prongs 22. Once the ball is secured in one of the seats, it may be lifted by the user from a standing and upright position into the user's hand by lifting the walking stick or pole 12.

Figure 4:
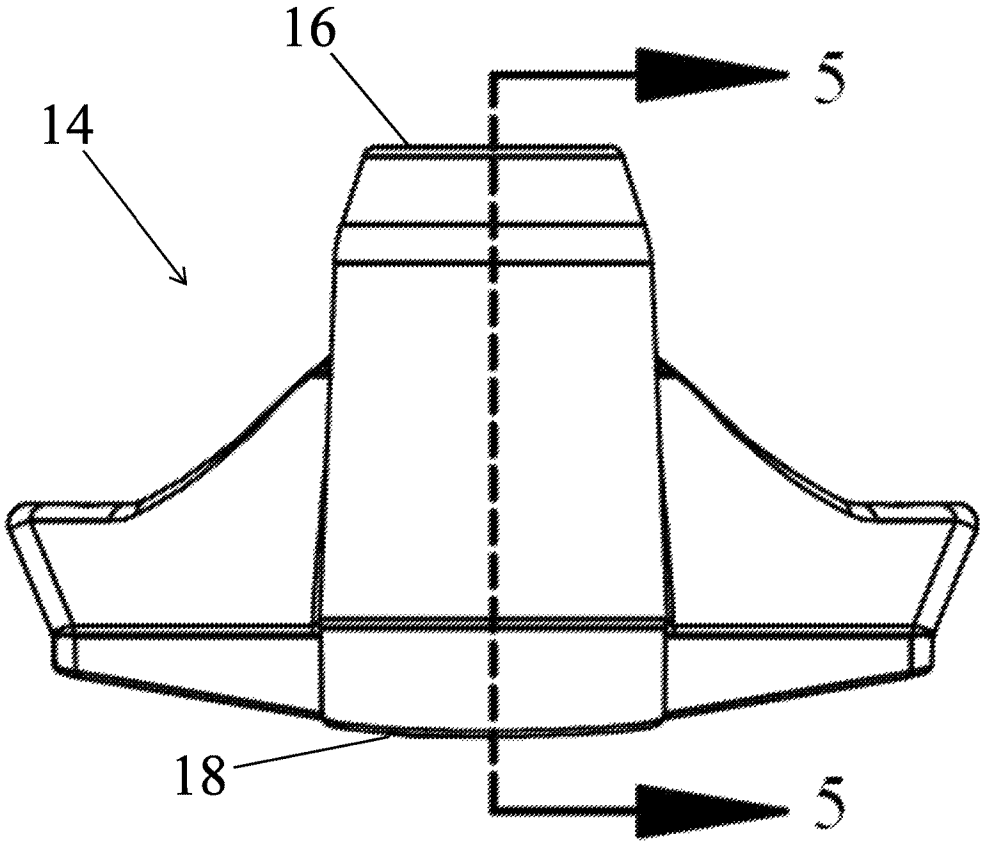
FIG. 4 is a back view of the base of FIG. 1.
Figure 5:
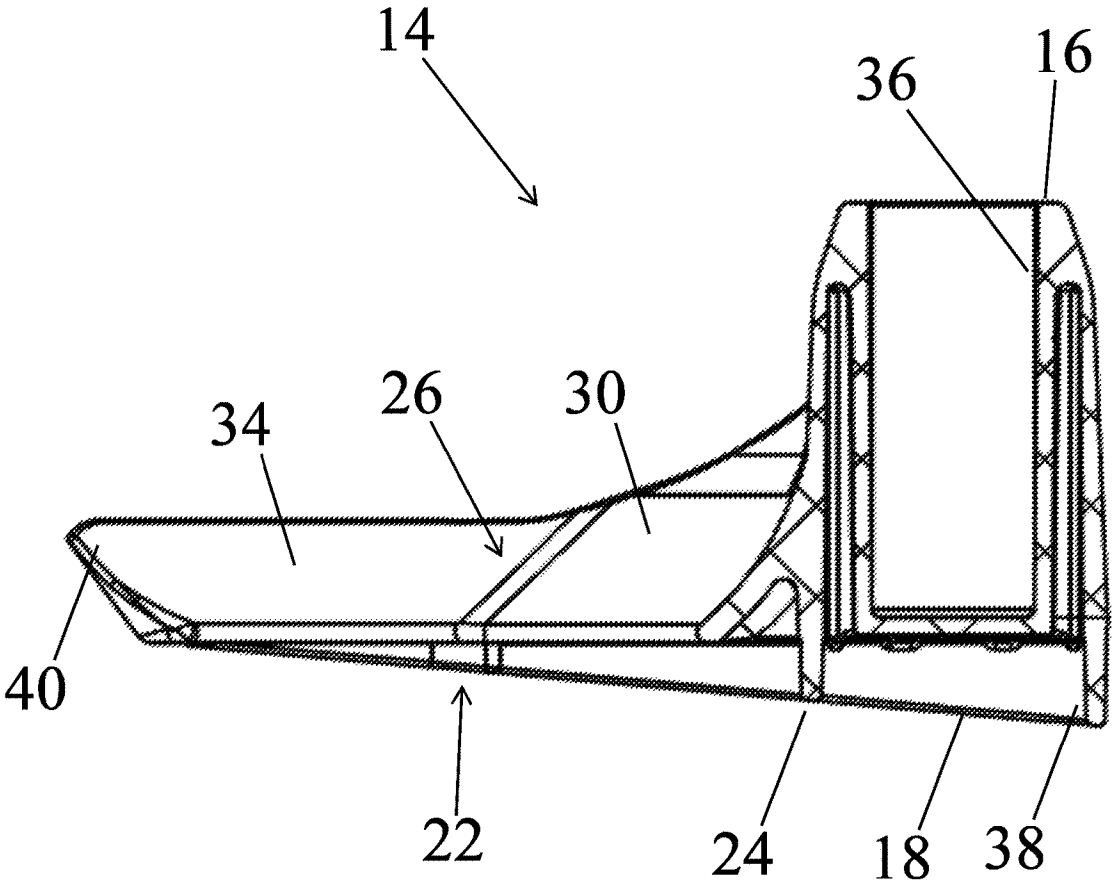
FIG. 5 is a section view of the base of FIG. 4 along line 5-5.

As illustrated by FIGS. 4-5, the lower surface 18 of the base 14 is opposite the upper surface 16 of the base 14. FIG. 5 additionally illustrates a point 24 from which the prongs 22 extend away from the base. The point 24 may be adjacent to the lower surface 18 of the base 14. The angle 38 between the walking stick or pole 12 and the lower surface 18 may be less than 90°. When the ball retriever 10 is placed with the lower surface 18 on a flat surface, the angle 38 causes the walking stick or pole 12 to lean slightly forward. This may place the center of gravity of the walking stick or pole 12 over the base 14 and allow the ball retriever 10 to stand while unattended. This further reduces the need to bend or crouch while using the ball retriever 10.

Where the above examples, embodiments and implementations reference examples, it should be understood by those of ordinary skill in the art that other ball retriever and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation.

In places where the description above refers to particular embodiments of a ball retriever, it should be readily apparent that a number of modifications may be made without departing from the spirit thereof and that these embodiments and implementations may be applied to other gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A bocce ball retriever, comprising:

a walking stick or pole; and a base comprising an upper surface, a lower surface opposite the upper surface, and a female receiver located in the upper surface and coupled to the walking stick or pole, the base comprising two prongs extending away from the base from a point adjacent to the lower surface, each of the two prongs comprising a contoured upper surface, wherein a first portion of the contoured upper surfaces of each of the two prongs together forming first and second arcuate sides of a first seat sized to receive a first ball size, and a second portion of the contoured upper surfaces of the two prongs forming first and second arcuate sides of a second seat sized to receive a second ball size larger than the first ball size, wherein the first arcuate side of the first seat and the first arcuate side of the second seat are continuous between each other, the second arcuate side of the first seat and the second arcuate side of the second seat are continuous between each other, and all of the first seat is closer to the female receiver than the second seat.

2. The bocce ball retriever of claim 1, the female receiver comprising a threaded surface.

3. The bocce ball retriever of claim 1, wherein the base is formed of an impact resistant plastic material comprising at least one of ABS, polycarbonate, and PDCPD plastic.

4. The bocce ball retriever of claim 1, the two prongs being made of a flexible material, wherein a ball having a weight of at least 1 pound producing an audible "snap" when falling into place between the two prongs.

5. The bocce ball retriever of claim 4, wherein the flexible material is an impact resistant plastic material comprising at least one of ABS, polycarbonate, and PDCPD plastic.

6. The bocce ball retriever of claim 1, wherein the walking stick or pole is detachable from the base.

7. The bocce ball retriever of claim 1, the base further comprising an angle between the lower surface of the base and the walking stick or pole, the angle being less than 90°.

8. The bocce ball retriever of claim 1, wherein each of the two prongs comprises an uncoupled end.

9. A bocce ball retriever, comprising:

a base with an upper surface and a coupler located on the upper surface; and two prongs extending outward from the base, each of the two prongs comprising a contoured upper surface, wherein a first portion of the contoured upper surfaces of each of the two prongs together forming first and second arcuate sides of a first seat sized to receive a first bocce ball size, and a second portion of the contoured upper surfaces of the two prongs forming first and second arcuate sides of a second seat sized to receive a second bocce ball size larger than the first bocce ball size, wherein the first arcuate side of the first seat and the first arcuate side of the second seat are continuous between each other, the second arcuate side of the first seat and the second arcuate side of the second seat are continuous between each other, and the first and second arcuate sides of the first seat are proximal to the base and the first and second sides of the second seat are distal to the base in relation to the first seat.

10. The bocce ball retriever of claim 9, the coupler comprising a threaded surface.

11. The bocce ball retriever of claim 9 further comprising a walking stick or pole detachably coupled to the coupler of the base.

12. The bocce ball retriever of claim 9, the base further comprising a lower surface, the two prongs extending away from the base from a point adjacent to the lower surface.

13. The bocce ball retriever of claim 9, wherein each of the two prongs comprises an uncoupled end.

14. The bocce ball retriever of claim 9, wherein the base is formed of an impact resistant plastic material comprising at least one of ABS, polycarbonate, and PDCPD plastic.

15. The ball retriever of claim 9, further comprising a walking stick or pole having a first end coupled to the coupler of the base at an angle of less than 90° and a second end distal from the first end, and a center of gravity of the walking stick or pole, the center of gravity of the walking stick or pole positioned over the base.

16. A ball retriever, comprising:

a base with an upper surface and a coupler located on the upper surface; and two prongs extending away from the base, each of the two prongs comprising a first portion and a second portion, the second portions of the two prongs positioned distal to the base in relation to the respective first portions, the first portions of the two prongs forming arcuate sides of a first seat having arcuate upper surfaces sized to mate with a first bocce ball size, the second portions of the two prongs comprising arcuate sides of a second seat having arcuate upper surfaces sized to mate with a second bocce ball size larger than the first bocce ball size, wherein the first and second portion of each of the two prongs form a continuous side of the respective prong.

17. The ball retriever of claim 16 further comprising a walking stick or pole coupled to the coupler of the base.

18. The ball retriever of claim 16, the two prongs being made of a flexible material, wherein a ball having a weight of at least 1 pound producing an audible "snap" when falling into place between the two prongs.

19. The ball retriever of claim 16, wherein the base is formed of an impact resistant plastic comprising at least one of ABS, polycarbonate, and PDCPD plastic.

20. The ball retriever of claim 16, further comprising a walking stick or pole having a first end coupled to the coupler of the base at an angle of less than 90° and a second end distal from the first end, and a center of gravity of the walking stick or pole, the center of gravity of the walking stick or pole positioned over the base.

* * * * *